US007600523B1

(12) United States Patent
Hawkesworth

(10) Patent No.: US 7,600,523 B1
(45) Date of Patent: Oct. 13, 2009

(54) ADJUSTABLE CANE AND ASSOCIATED METHOD

(76) Inventor: M. William Hawkesworth, 6306 Horseshoe Bay Rd., Boynton Beach, FL (US) 33437

( * ) Notice: Subject to any disclaimer, the term of this patent is extended or adjusted under 35 U.S.C. 154(b) by 118 days.

(21) Appl. No.: 11/784,587

(22) Filed: Apr. 9, 2007

Related U.S. Application Data

(60) Provisional application No. 60/789,947, filed on Apr. 7, 2006.

(51) Int. Cl.
*A45B 9/00* (2006.01)

(52) U.S. Cl. ..... 135/65; 135/75; 135/82

(58) Field of Classification Search ..... 135/65, 135/69, 75, 76, 82
See application file for complete search history.

(56) References Cited

U.S. PATENT DOCUMENTS 1,817,829 A * 8/1931 Lanning ..... 135/82
2,183,975 A * 12/1939 Savage ..... 135/66
3,335,735 A * 8/1967 Colegrove et al. ..... 135/69
3,947,140 A * 3/1976 Thomas ..... 403/108
4,044,784 A * 8/1977 Smith ..... 135/67
5,806,548 A * 9/1998 Goldstein et al. ..... 135/65
6,286,529 B1 * 9/2001 Olivera ..... 135/82
6,595,226 B2 * 7/2003 Uemura ..... 135/75
6,782,903 B1 * 8/2004 Jarman et al. ..... 135/75
7,104,271 B2 * 9/2006 Larson et al. ..... 135/73

* cited by examiner

*Primary Examiner*—David Dunn
*Assistant Examiner*—Noah Chandler Hawk

(57) ABSTRACT

An adjustable cane includes a shaft with proximal and distal ends. The shaft has a hollow cavity formed therein and extending along a major length of the shaft and terminating subjacent to the proximal end. A stop member is threadably attached to the distal end of the shaft and extends about an entire circumference thereof. A handle has upper and lower portions, and the lower portion is removably attached to the proximal end of the shaft. A rectilinear core member with top and bottom ends is telescopically interfitted within the distal end of the shaft and penetrates the cavity, and a cap is removably fitted over the bottom end. A mechanism telescopically adjusts the core member within the shaft in such a manner that the shaft remains statically affixed to the handle while the core member linearly displaces along the distal end of the shaft.

3 Claims, 5 Drawing Sheets

ADJUSTABLE CANE AND ASSOCIATED METHOD

CROSS REFERENCE TO RELATED APPLICATIONS

This application claims the benefit of U.S. Provisional Application No. 60/789,947, filed Apr. 7, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to canes and, more particularly, to an adjustable cane for assisting a user of different heights to comfortably employ the cane while walking or standing.

2. Prior Art

While walking canes are tremendously helpful in assisting the physically impaired, there are a number of drawbacks associated with their use. Specifically, the basic design of a walking cane belies the fact that employing such an instrument can actually cause additional problems for the user if the cane is not carefully selected for the individual user. A cane that is too short causes the user to lean to the side, and can lead to a strain on a user back. If a cane is too long or too 'high', it causes the user elbow to bend too much, making the arm work harder from a disadvantaged position. As canes are rigid, it is important to select a cane that fits the specific height requirements of an individual to minimize the amount of impact that is transferred to the user each time the cane is placed on the ground.

One prior art example shows a walking cane comprising a base plate having an undersurface and an opening extending through the base plate, and a substantially U-shaped reinforcing plate comprised of a central plate and two substantially parallel leg plates connected together by the central plate. The leg plates each have a free edge positioned adjacent to the undersurface of the base plate, and the central plate has an opening. An upright support includes a lower end extending through the openings of the base plate and the central plate and connected to the base plate and the central plate thereat, respectively, and an upper end has a handle for permitting the user to grasp the cane. A plurality of legs supports the cane on a surface, with the plurality of legs being connected to the substantially U-shaped reinforcing plate at outer surfaces of the leg plates and being connected to the undersurface of the base plate such that the legs are in spaced relation to the upright support. Unfortunately, such a cane can be heavy and awkward to move and thereby be inadequate for a user with reduced strength.

Another prior art example shows an adjustable cane for physical therapy that includes an adjustable base member and an elongated bar member detachably secured to the base member. The bar member comprises an elongated tube member and a longitudinal rod member slidably and adjustably received in the tube member. The base member is composed of a pair of identical base units each of which has an aperture at a center portion adopted to secure the bottom portion of the rod member therein, and a plurality of recesses adopted to secure supporting legs and linking rod members thereat. Whereas the linking rod member permits the supporting legs to be lifted upwardly for storage and to be put down for supporting user's weight. Unfortunately, this prior art example is complicated to assemble, and in addition, has a wide base member which can interfere with a user foot movement while walking and thereby cause a user to fall.

Accordingly, a need remains for an adjustable cane in order to overcome the above-noted shortcomings. The present invention satisfies such a need by providing an apparatus that is convenient and easy to use, is lightweight yet durable in design, and assists a user of different heights to comfortably employ a cane while walking or standing. Such a cane affords greater locomotion control, and eases the shock to the user arm and hand that results from repeated striking of the cane against a hard surface during walking conditions. The cane's adjustability alleviates back and joint pain associated with rigid, ill-fitting walking canes, and the physical assistance provided by the cane serves to give the user a psychological boost as well. The present invention is simple to use, inexpensive, and designed for many years of repeated use.

BRIEF SUMMARY OF THE INVENTION

In view of the foregoing background, it is therefore an object of the present invention to provide an apparatus for an adjustable cane. These and other objects, features, and advantages of the invention are provided by an adjustable cane for assisting a user of different heights to comfortably employ said cane while walking or standing.

The apparatus includes an elongated shaft that has axially opposed proximal and distal ends respectively. Such a shaft has a hollow cavity advantageously formed therein and effectively extending along a major longitudinal length of the shaft and terminating subjacent to the proximal end. The shaft further has a durable stop member directly and threadably attached to the distal end of the shaft and effectively extending about an entire circumference thereof to thereby prevent the bottom end (herein described below) of the core member (herein described below) from entering into the cavity of the shaft.

The apparatus further includes a handle that has upper and lower portions respectively. Such a lower portion is removably attached to the proximal end of the shaft. The handle has a curvilinear middle portion such that the lower portion of the handle is advantageously oriented perpendicular to the upper portion of the handle. Such an upper portion of the handle conveniently has a removable outer sleeve formed from durable and resilient material fitted thereabout.

The apparatus further includes a rectilinear core member that has axially opposed top and bottom ends. Such a core member is telescopically interfitted within the distal end of the shaft and penetrates into the cavity. The core member has a diameter less than a diameter of the distal end of the shaft, and further has a longitudinal length less than the longitudinal length of the shaft. A cap is removably fitted over the bottom end of the core member.

The apparatus further includes a mechanism for telescopically adjusting the core member within the shaft in such a manner that the shaft effectively remains statically affixed to the handle while the core member linearly displaces along the distal end of the shaft. Such a telescopically adjusting mechanism includes a deformably resilient spring-member housed within the cavity. Such a spring-member has a first end directly attached to the proximal end of the shaft, and a second end directly attached to the top end of the core member. The spring-member is compressible along the longitudinal length of the shaft when a downward pressure is applied to the handle. Such a downward pressure is effectively transferred to the shaft and thereby forces the core member upwardly into the cavity and advantageously reduces harmful shock to the user arm and hand during walking conditions. The spring-member is conveniently returned to an equilibrium position when the downward pressure is removed from the handle.

The apparatus further includes a mechanism for selectively adjusting the proximal end of the shaft within the lower portion of the handle such that the overall length of the cane is selectively adapted along a linear plane. Such a selectively adjusting mechanism is conveniently located within the lower portion of the handle. The selectively adjusting mechanism includes a detent directly coupled to the proximal end of the shaft wherein the proximal end of the shaft is advantageously displaceable within the lower portion of the handle when the detent is compressed to an unlocked position. A plurality of holes is formed in an outer surface of the lower portion of the handle, and the detent is conveniently abutted through a selected one of the holes when adapted to a locked position.

The telescopically adjusting mechanism and the selectively adjusting mechanism are independently and simultaneously actuated during operating conditions.

A method for assisting a user of different heights to comfortably employ an adjustable cane while walking or standing includes the steps of providing an elongated shaft that has axially opposed proximal and distal ends respectively. Such a shaft has a hollow cavity formed therein and extends along a major longitudinal length of the shaft and terminates subjacent to the proximal end. The steps further include removably attaching a handle that has upper and lower portions respectively to the proximal end of the shaft, and telescopically interfitting a rectilinear core member within the distal end of the shaft. Such a core member has axially opposed top and bottom ends, and the top end penetrates the cavity.

The method further includes the steps of threadably attaching a durable stop member directly to the distal end of the shaft. Such a stop member extends about an entire circumference of the shaft to thereby prevent the bottom end of the core member from entering into the cavity of the shaft. The steps further include removably fitting a cap over the bottom end of the core member, and telescopically adjusting the core member within the shaft in such a manner that the shaft remains statically affixed to the handle while the core member linearly displaces along the distal end of the shaft.

The steps of selectively adjusting the proximal end of the shaft within the handle includes the steps of, while telescopically adjusting the core member within the shaft (herein described below), selectively adjusting the proximal end of the shaft within the lower portion of the handle such that the overall length of the cane is selectively adapted along a linear plane. The steps further include compressing a detent located within the lower portion of the handle wherein the detent is directly coupled to the proximal end of the shaft, displacing the proximal end of the shaft within the handle, and abutting and locking the detent through a selected one of a plurality of holes formed in an outer surface of the lower portion of the handle. The selectively adjusting mechanism is located within the lower portion of the handle.

The telescopically adjusting mechanism includes the steps of applying a downward pressure to the handle, compressing a deformably resilient spring-member along the longitudinal length of the shaft, transferring the downward pressure to the shaft, forcing the core member upwardly into the cavity and thereby reducing harmful shock to the user arm and hand during walking conditions, and returning the spring-member to an equilibrium position when the downward pressure is removed from the handle. The spring-member is housed within the cavity. The spring-member has a first end directly attached to the proximal end of the shaft, and a second end directly attached to the top end of the core member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
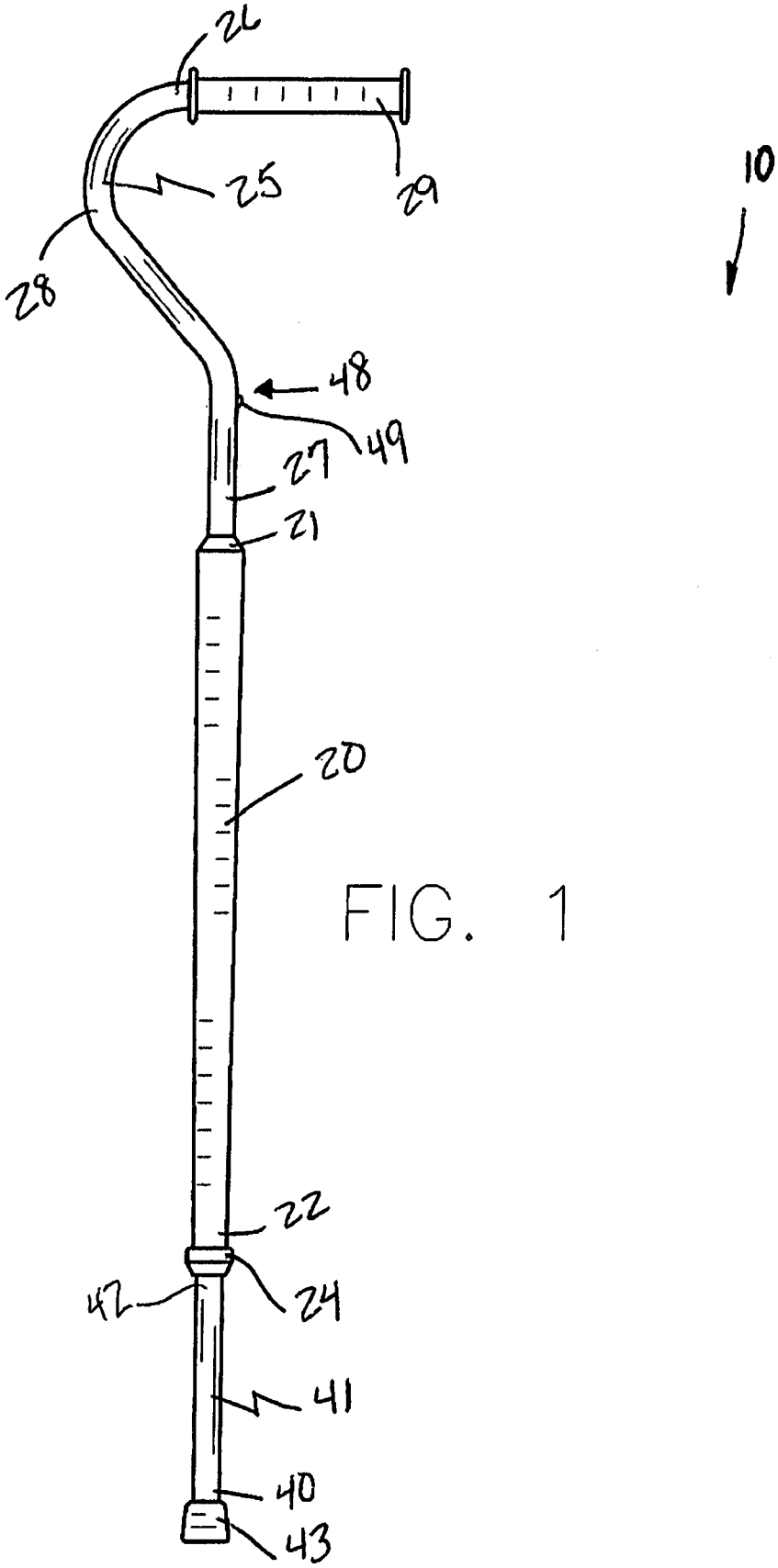
FIG. 1 is a side elevational view of an adjustable cane, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus and method of this invention are referred to generally in FIGS. 1-5 by the reference numeral 10 and are intended to provide an adjustable cane. It should be understood that the apparatus and method 10 may be used to assist many different types of individuals in many different types of activities and should not be limited in use to assisting only those types of individuals in those types of activities described herein.

Referring initially to FIGS. 1, 2, 3, 4 and 5 the apparatus 10 includes an elongated shaft 20 that has axially opposed proximal 21 and distal 22 ends respectively. Such a shaft has a hollow cavity 23 advantageously formed therein and extending along a major longitudinal length of the shaft 20 and terminating subjacent to the proximal end 21. The shaft 20 further has a durable stop member 24 directly and threadably attached to the distal end 22 of the shaft 20, without the use of intervening elements, and extending about an entire circumference thereof to thereby prevent the bottom end 40 (herein described below) of the core member 41 (herein described below) from entering into the cavity 23 of the shaft 20. Such a stop member 24 can be easily replaced when worn or damaged, or replaced with a differently sized stop member 24 based upon user desire.

Again referring to FIGS. 1 through 5, the apparatus 10 further includes a handle 25 that has upper 26 and lower 27 portions respectively. Such a lower portion 27 is removably attached to the proximal end 21 of the shaft 20, which is essential such that the handle 25 can be removed for storage and transportation of the apparatus 10 when not in use. The handle 25 has a curvilinear middle portion 28 such that the lower portion 27 of the handle 25 is advantageously oriented perpendicular to the upper portion 26 of the handle 25, which is critical such that the user can easily manipulate the apparatus 10 during walking conditions. Such an upper portion 26 of the handle 25 has a removable outer sleeve 29 formed from durable and resilient material fitted thereabout. Such a sleeve 29 provides a comfortable and secure gripping surface for the user hand during walking conditions, and the removability of the sleeve 29 allows the user to easily replace a worn or damaged sleeve 29 as desired.

Referring to FIGS. 1, 2, 4 and 5, the apparatus 10 further includes a rectilinear core member 41 that has axially opposed top 42 and bottom 40 ends. Such a core member 41 is telescopically interfitted within the distal end 22 of the shaft 20 and penetrates into the cavity 23. The core member 41 has a diameter less than a diameter of the distal end 22 of the shaft 20, and further has a longitudinal length less than the longitudinal length of the shaft 20. The diameter of the core member 41 allows the same to freely slide within the shaft 20 during walking conditions, and thereby prevent unnecessary friction between the core member 41 and the shaft 20 respectively, which can cause undesirable wear on the same and prematurely shorten the usable lifespan of the apparatus 10. A cap 43 is removably fitted over the bottom end 40 of the core member 41. Such a cap 43 is formed from rigid and durable material, which is crucial such that the cap 43 prevents the bottom end 40 of the core member 41 from contacting a ground surface during walking conditions, thereby preventing undesirable damage to the core member 41, as well as beneficially reducing harmful shock to the user hand and arm while employing the apparatus 10.

Again referring to FIGS. 4 and 5, the apparatus 10 further includes a mechanism 44 for telescopically adjusting the core member 41 within the shaft 20 in such a manner that the shaft 20 remains statically affixed to the handle 25 while the core member 41 linearly displaces along the distal end 22 of the shaft 20. Such a telescopically adjusting mechanism 44 operates automatically while the user employs the apparatus 10, and eliminates the need for the user to manually adjust the telescopically adjusting mechanism 44 during walking conditions. Such a telescopically adjusting mechanism 44 includes a deformably resilient spring-member 45 housed within the cavity 23. Such a spring-member 45 has a first end 46 directly attached to the proximal end 21 of the shaft 20, without the use of intervening elements, and a second end 47 directly attached to the top end 42 of the core member 41, without the use of intervening elements.

Figure 2:
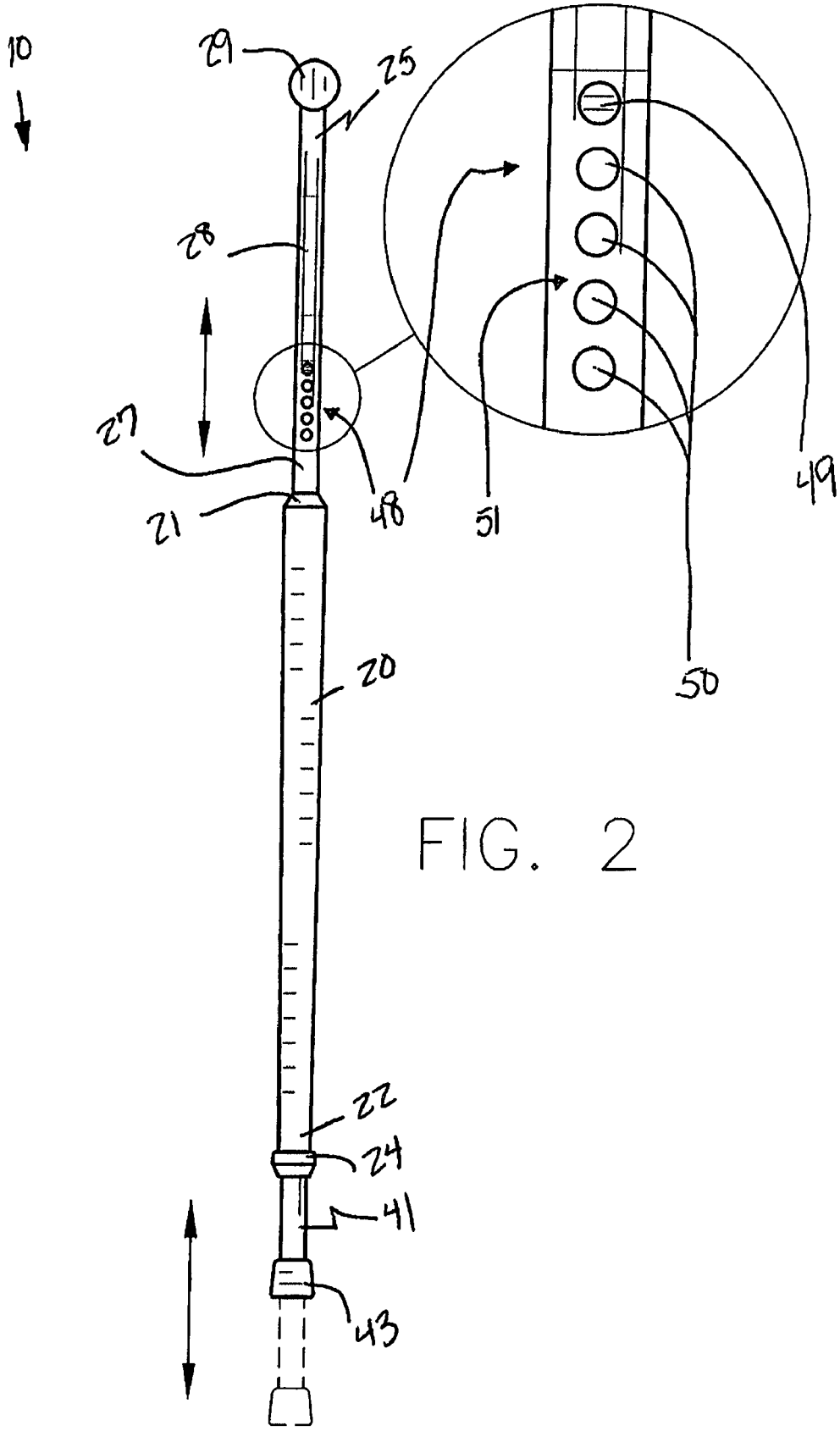
FIG. 2 is a rear elevational view of the apparatus shown in FIG. 1, showing an expanded view of the selectively adjusting mechanism.
Figure 3:
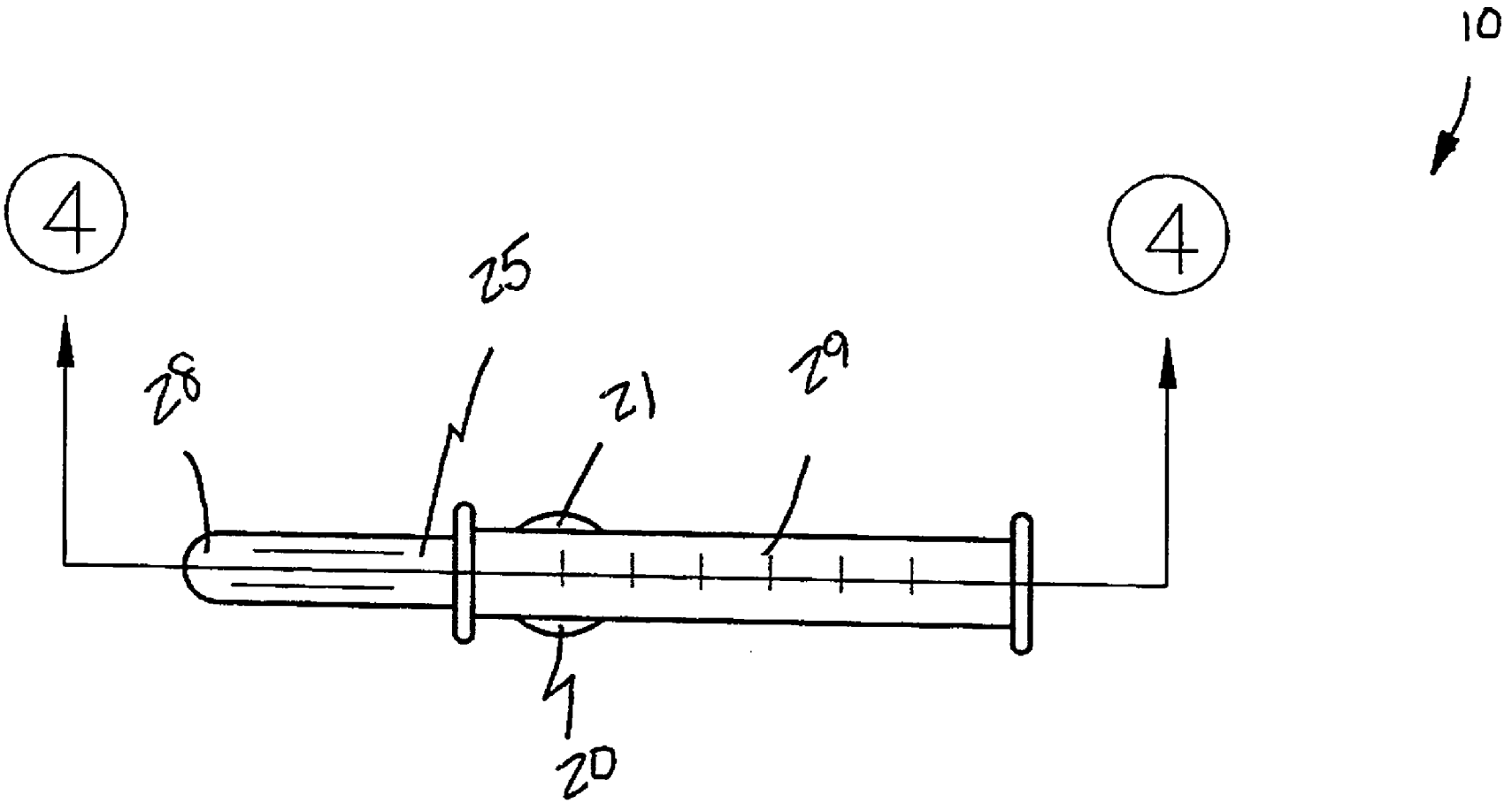
FIG. 3 is a top plan view of the apparatus shown in FIG. 1.
Figure 4:
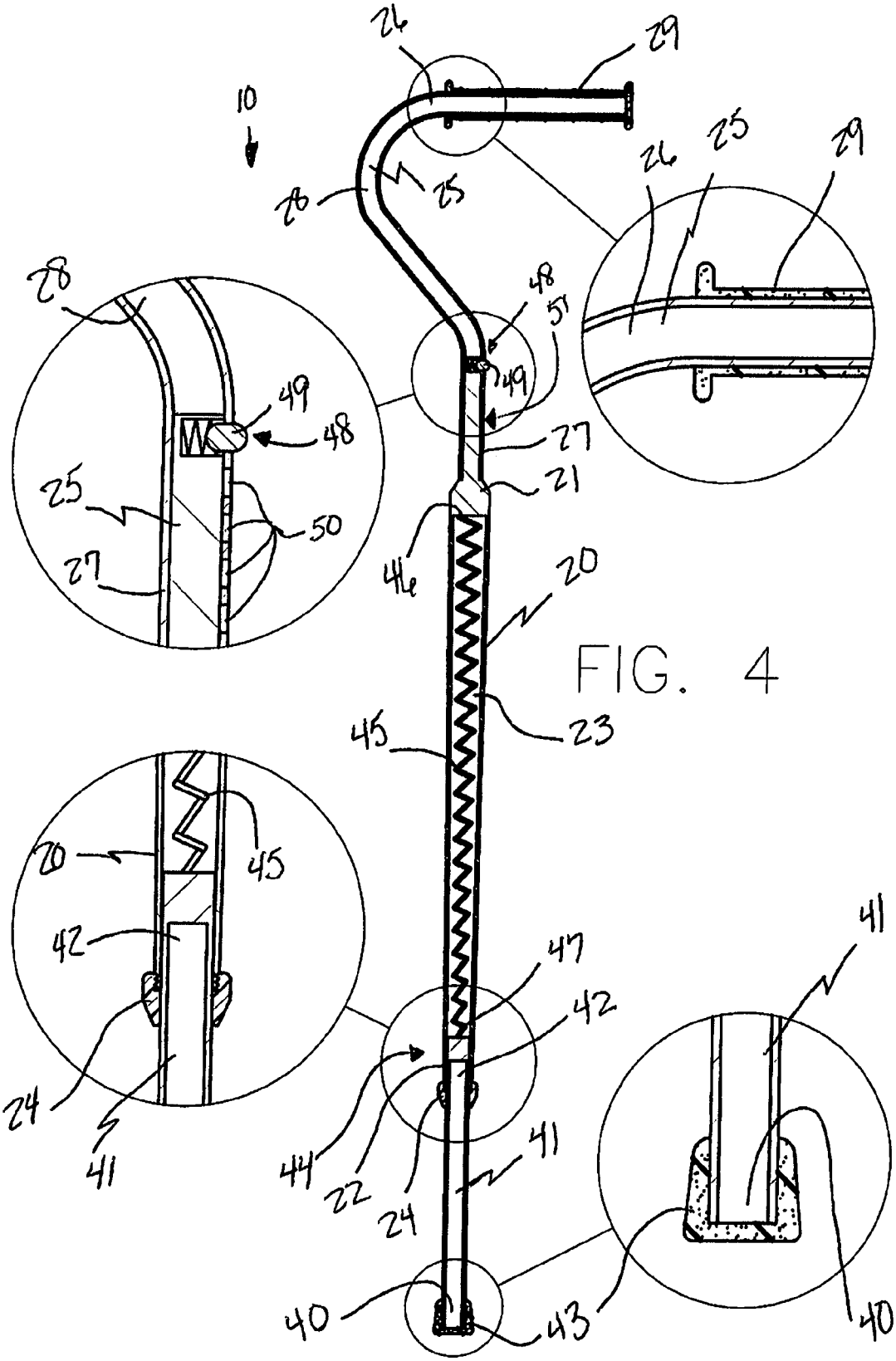
FIG. 4 is a cross sectional view of the apparatus shown in FIG. 3, taken along line 4-4, and further showing enlarged views of the handle, the cap, the telescopically adjusting mechanism, and the selectively adjusting mechanism respectively.
Figure 5:
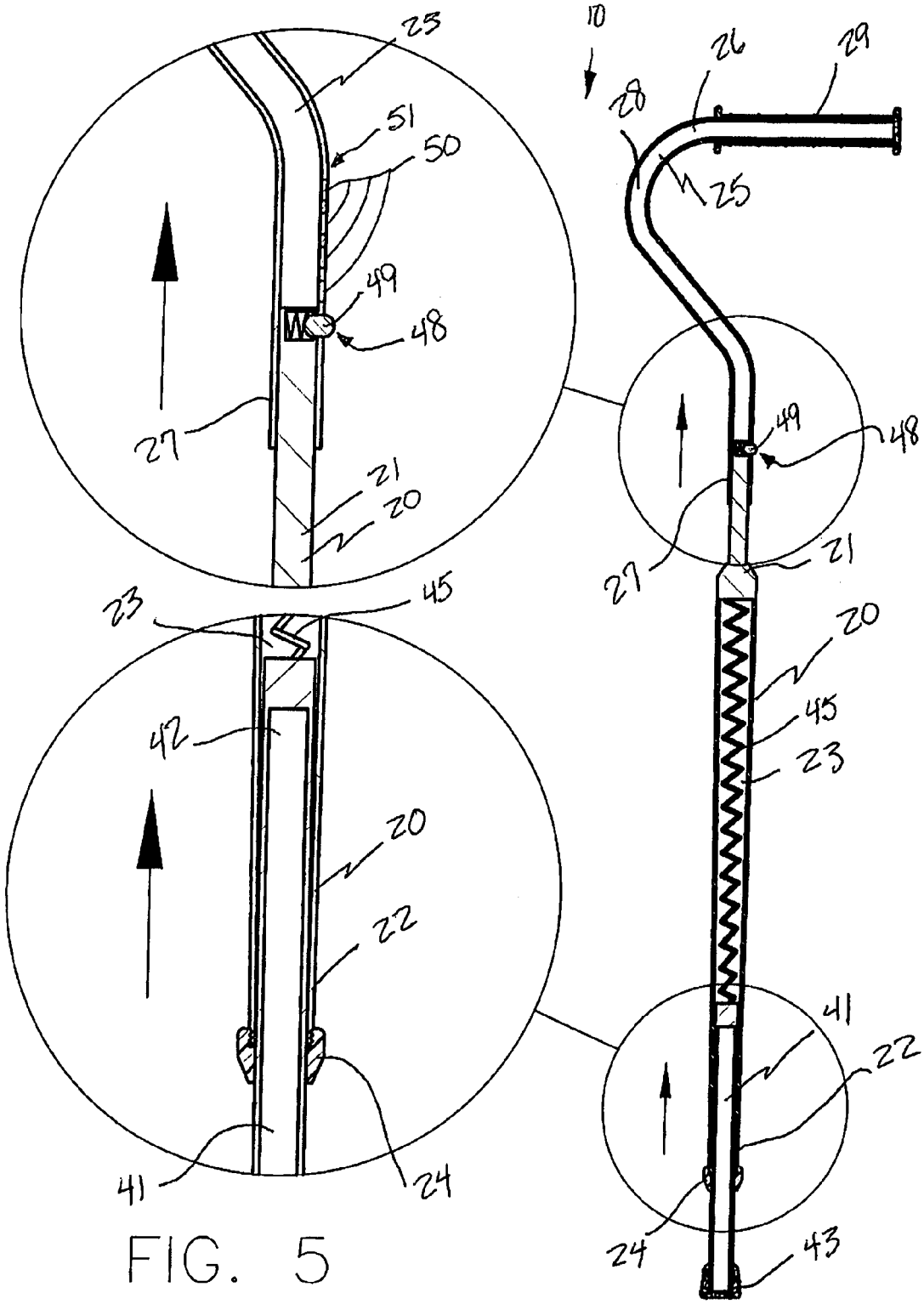
FIG. 5 is a cross sectional view of the apparatus shown in FIG. 4, showing respective enlarged views of the handle being adjusted upwardly, and the core member being forced into the distal end of the shaft.

Referring to FIGS. 2, 4 and 5, the spring-member 45 is compressible along the longitudinal length of the shaft 20 when a downward pressure is applied to the handle 25. Such a downward pressure is transferred to the shaft 20 and thereby forces the core member 41 upwardly into the cavity 23 and advantageously reduces harmful shock to the user arm and hand during walking conditions. The spring-member 41 is returned to an equilibrium position when the downward pressure is removed from the handle 25. For example, as the user walks, the user places the cap 43 against the ground surface and then applies a downward pressure to the shaft 20 via the handle 25. The spring-member 45 compresses, gradually cushioning the force exerted against the user hand and arm as the user moves forward. When the user removes the cap 43 from contact with the ground surface, the spring-member 45 returns to an equilibrium position and is positioned properly for the next step.

Again referring to FIGS. 1, 2, 4 and 5, the apparatus 10 further includes a mechanism 48 for selectively adjusting the proximal end 21 of the shaft 20 within the lower portion 27 of the handle 25, which is vital such that the overall length of the cane 10 is selectively adapted along a linear plane. Such a selectively, adjusting mechanism 48 allows a user to purchase one apparatus 10 and adjust the length thereof, such that the apparatus 10 can be employed by more than one user of different heights. The selectively adjusting mechanism 48 is located within the lower portion 27 of the handle 25, which is important such that the user can easily adjust the length of the apparatus 10 as desired.

Yet again referring to FIGS. 1, 2, 4 and 5, the selectively adjusting mechanism 48 includes a detent 49 directly coupled to the proximal end 21 of the shaft 20, without the use of intervening elements, wherein the proximal end 21 of the shaft 20 is advantageously displaceable within the lower portion 27 of the handle 25 when the detent 49 is compressed to an unlocked position. A plurality of holes 50 is formed in an outer surface 51 of the lower portion 27 of the handle 25, and the detent 49 is abutted through a selected one of the holes 50 when adapted to a locked position. Such holes 50 provide a multitude of options for the user to choose from when determining a length of the apparatus 10.

The telescopically adjusting mechanism 44 and the selectively adjusting mechanism 48 are independently and simultaneously actuated during operating conditions. Such simultaneous and independent operation of the mechanisms 44, 48 allows the user to quickly and easily adjust the length of the apparatus 10 as desired via the selectively adjusting mechanism 48, while simultaneously enjoying the benefits of the automatic adjustment of the telescopically adjusting mechanism 44.

In use, the adjustable cane 10 is simple and straightforward to use. First, the user grips the apparatus 10 by the handle 25 and places the cap 43 against the ground surface. The user then exerts a downward pressure against the shaft 20 via the handle 25 and moves forward. The downward pressure compresses the spring-member 45 and lessens the impact against the user hand and arm. The user then lifts the apparatus 10 and repositions the cap 43 against the ground surface for the next step. This process is repeated with each step the user takes.

The simultaneous and independent operation of the telescopically adjusting mechanism 44 and the selectively adjusting mechanism 48 respectively provide the unexpected benefit of allowing the user to manually adjust the selectively adjusting mechanism 48 while simultaneously enjoying the benefits of the telescopically adjusting mechanism 44 during walking conditions. In addition, the small size of the cap 43 eliminates interference by same with a user foot while walking, and thereby reduces the possibility of causing injury to the user. Also, the spring-member 45 beneficially reduces the harmful shock to a user hand and arm during walking conditions, thereby overcoming the prior art shortcomings.

A method 10 for assisting a user of different heights to comfortably employ an adjustable cane 10 while walking or standing includes the steps of providing an elongated shaft 20 that has axially opposed proximal 21 and distal 22 ends respectively. Such a shaft 20 has a hollow cavity 23 formed therein and extends along a major longitudinal length of the shaft 20 and terminates subjacent to the proximal end 21. The steps further include removably attaching a handle 25 that has upper 26 and lower 27 portions respectively to the proximal end 21 of the shaft 20, and telescopically interfitting a rectilinear core member 41 within the distal end 22 of the shaft 20. Such a core member 41 has axially opposed top 42 and bottom 40 ends, and the top end 42 penetrates the cavity 23.

The method 10 further includes the steps of threadably attaching a durable stop member 24 directly to the distal end 22 of the shaft 20, without the use of intervening elements. Such a stop member 24 extends about an entire circumference of the shaft 20 to thereby prevent the bottom end 40 of the core member 41 from entering into the cavity 23 of the shaft 20. The steps further include removably fitting a cap 43 over the bottom end 40 of the core member 41, and telescopically adjusting the core member 41 within the shaft 20 in such a manner that the shaft 20 remains statically affixed to the handle 25 while the core member 41 linearly displaces along the distal end 22 of the shaft 20.

The steps of selectively adjusting the proximal end 21 of the shaft 20 within the handle 25 includes the steps of, while telescopically adjusting the core member 41 within the shaft 20, selectively adjusting the proximal end 21 of the shaft 20 within the lower portion 27 of the handle 25 such that the overall length of the cane 10 is selectively adapted along a linear plane. The steps further include compressing a detent 49 located within the lower portion 27 of the handle 25 wherein the detent 49 is directly coupled to the proximal end 21 of the shaft 20, without the use of intervening elements, displacing the proximal end 21 of the shaft 20 within the handle 25, and abutting and locking the detent 49 through a selected one of a plurality of holes 50 formed in an outer surface 51 of the lower portion 27 of the handle 25. The selectively adjusting mechanism 48 is located within the lower portion 27 of the handle 25.

The telescopically adjusting mechanism 44 includes the steps of applying a downward pressure to the handle 25, compressing a deformably resilient spring-member 45 along the longitudinal length of the shaft 20, transferring the downward pressure to the shaft 20, forcing the core member 41 upwardly into the cavity 23 and thereby reducing harmful shock to the user arm and hand during walking conditions, and returning the spring-member 41 to an equilibrium position when the downward pressure is removed from the handle 25. The spring-member 41 is housed within the cavity 23. The spring-member 41 has a first end 46 directly attached to the proximal end 21 of the shaft 20, without the use of intervening elements, and a second end 47 directly attached to the top end 42 of the core member 41, without the use of intervening elements.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A method for assisting a user of different heights to comfortably employ an adjustable cane while walking or standing, said method comprising the steps of:

a. providing an elongated shaft having axially opposed proximal and distal ends respectively, said shaft having a hollow cavity formed therein and extending along a major longitudinal length of said shaft and terminating subjacent to said proximal end;

b. removably attaching a handle having upper and lower portions respectively to said proximal end of said shaft;

c. telescopically interfitting a rectilinear core member within said distal end of said shaft, said core member having axially opposed top and bottom ends, said top end penetrating said cavity;

d. threadably attaching a durable stop member directly to said distal end of said shaft, said stop member extending about an entire circumference of said shaft to thereby prevent said bottom end of said core member from entering into said cavity of said shaft;

e. removably fitting a cap over said bottom end of said core member;

f. telescopically adjusting said core member within said shaft in such a manner that said shaft remains statically affixed to said handle while said core member linearly displaces along said distal end of said shaft;

g. while performing step f., selectively adjusting said proximal end of said shaft within said lower portion of said handle such that the overall length of said cane is selectively adapted along a linear plane, said selectively adjusting means being located within said lower portion of said handle, wherein step g. further comprises the steps of i. compressing a detent located within said lower portion of said handle, said detent being directly coupled to said proximal end of said shaft, ii. displacing said proximal end of said shaft within said handle, and iii. abutting and locking said detent through a selected one of a plurality of holes formed in an outer surface of said lower portion of said handle;

h. applying a downward pressure to said handle;

i. compressing a spring-member along said longitudinal length of said shaft;

j. transferring said downward pressure to said shaft;

k. forcing said core member upwardly into said cavity and thereby reducing harmful shock to the user arm and hand during walking conditions; and l. returning said spring-member to an equilibrium position when said downward pressure is removed from said handle, said deformably resilient spring-member being housed within said cavity, said spring-member having a first end directly attached to said proximal end of said shaft, said spring-member further having a second end directly attached to said top end of said core member.

2. The method of claim 1, wherein said handle has a curvilinear middle portion such that said lower portion of said handle is oriented perpendicular to said upper portion of said handle, said upper portion of said handle having a removable outer sleeve formed from durable and resilient material fitted thereabout.

3. The method of claim 1, wherein said core member has a diameter less than a diameter of said distal end of said shaft, said core member further having a longitudinal length less than said longitudinal length of said shaft.

* * * * *

UNITED STATES PATENT AND TRADEMARK OFFICE

CERTIFICATE OF CORRECTION

PATENT NO. : 7,600,523 B1
APPLICATION NO. : 11/784587
DATED : October 13, 2009
INVENTOR(S) : M. William Hawkesworth It is certified that error appears in the above-identified patent and that said Letters Patent is hereby corrected as shown below:

On the Title Page, Item (76)

Please correct the inventor's address as indicated below:

[[6306]] 8306 Horseshoe Bay Road
Boynton Beach, FL 33437

Signed and Sealed this

Fifteenth Day of December, 2009

David J. Kappos

David J. Kappos
*Director of the United States Patent and Trademark Office*